United States Patent [19]

Hansen

[11] Patent Number: 4,736,495

[45] Date of Patent: Apr. 12, 1988

[54] SLIDE FASTENER WITH PREFABRICATED COUPLING ELEMENT

[75] Inventor: Henning Hansen, Aichtal-Aich, Fed. Rep. of Germany

[73] Assignee: OPTI Patent-, Forschungs- und Fabrikations- AG, Riedern-Allmeind, Switzerland

[21] Appl. No.: 38,033

[22] Filed: Apr. 14, 1987

[30] Foreign Application Priority Data

Apr. 15, 1986 [DE] Fed. Rep. of Germany ..... 3612612

[51] Int. Cl.[4] ..... A44B 19/40

[52] U.S. Cl. ..... 24/396; 24/392

[58] Field of Search ..... 24/396, 392, 399, 398, 24/397, 400, 418, 419

[56] References Cited

U.S. PATENT DOCUMENTS

| | | | |
|---|---|---|---|
| 2,996,780 | 8/1961 | Porepp | 24/396 |
| 3,263,291 | 8/1966 | Taylor | 24/396 |
| 3,490,108 | 1/1970 | Frohlich | 24/392 |
| 3,588,967 | 6/1971 | Speck | 24/396 |
| 4,267,621 | 5/1981 | Akashi | 24/396 |

FOREIGN PATENT DOCUMENTS

| | | | |
|---|---|---|---|
| 781649 | 4/1968 | Canada | 24/396 |
| 1810440 | 7/1969 | Fed. Rep. of Germany | 24/396 |
| 1940734 | 2/1971 | Fed. Rep. of Germany | 24/392 |
| 2855370 | 12/1974 | Fed. Rep. of Germany . | |
| 2519829 | 11/1976 | Fed. Rep. of Germany . | |

*Primary Examiner*—Victor N. Sakran

*Attorney, Agent, or Firm*—Karl F. Ross; Herbert Dubno

[57] ABSTRACT

A sliding clasp fastener having woven supporting tapes and woven-in prefabricated rows of interlocking members each formed helically from a plastics monofilament, in which the interlocking members, seen in a projection on the plane of the sliding clasp fastener, have limbs superimposed on at least the interlock side, interlocking heads protruding beyond the edges of the supporting tapes, an inserted core and attachment sections. Each row of interlocking members is attached to the top face of its supporting tape by binding chain threads engaging the interlock side of each interlocking member and at least one wrapping thread engaging the attachment sections and the core and attaching them to the supporting tapes. The binding chain threads are crossed over between successive interlocking members. The wrapping threads pass around the binding chain threads in a loop between successive interlocking members. The attachment sections, seen in a projection on the plane of the sliding clasp fastener, are disposed in the middle of the interlocking members, some distance from the interlocking heads but also some distance from the rearward return loops. The binding chain threads are disposed in the supporting tapes beneath the middle of the interlocking members and drawn on to the attachment sections by the loops of the wrapping threads which pass partly around the attachment sections.

5 Claims, 3 Drawing Sheets

SLIDE FASTENER WITH PREFABRICATED COUPLING ELEMENT

FIELD OF THE INVENTION

Our present invention relates to slide fasteners and, more particularly, to slide fastener stringers having a woven support tape and a helical continuous coupling element affixed to one edge of the tape so that it is retained at least in part by threads which form part of the weave so that the coupling elements, even though prefabricated and not made in the course of weaving, can be said to be woven into the tape.

BACKGROUND OF THE INVENTION

A slide fastener generally comprises a slide-fastener stringer made up of two slide-fastener halves, each of which has a support tape along and edge of which a coupling element is provided. The coupling element can be continuous, generally helical and formed from a synthetic resin or plastic monofilament, e.g. a nylon or other polyamide or a polyester.

The coupling element is, in turn, formed with a row of interlocking members whose coupling heads project beyond the edge of the tape and are adapted to interdigitate with the coupling element of the other fastener half when a slider is drawn therealong between end stop members. Each coupling head can have a pair of shanks or limbs running inwardly from the edge and the limbs can be chained together by bights or return loops.

A core, e.g. a cord, string or heavy thread of textile material, can extend through the interior of the coupling element and can stabilize the latter, facilitate the attachment to the tape or otherwise provide a structural asset.

A sliding clasp fastener thus can have woven supporting tapes and woven-in prefabricated rows of interlocking members each formed helically from a plastics monofilament, in which the interlocking members, seen in a projection on the plane of the sliding clasp fastener, can have limbs superimposed on at least the interlock side.

Interlocking heads protrude beyond the edges of the supporting tapes, and an inserted core and attachment sections are provided. Each row of interlocking members is attached to the top face of its supporting tape by binding chain threads engaging the interlock side of each interlocking member and at least one wrapping thread engaging the attachment sections and the core and attaching them to the supporting tape.

The binding chain threads are crossed over between successive interlocking members, and the wrapping threads pass round the binding chain threads in a loop between successive interlocking members.

Unlike the so-called woven type of sliding clasp fastener, the rows of interlocking members in the type of sliding clasp fastener with which the invention is connected, are not produced by a weaving process when weaving the supporting tapes, but are in contrast prefabricated and incorporated as completed chains of interlocking members when the supporting tapes are woven. The wrapping threads can be weft threads or chain stitches with a special cross-weave (for example a twill weave).

In the known sliding clasp fasteners of this type which are currently in use, the attachment sections also act as connecting sections between the interlocking members in the row. In other words, they are rearward arcuate links between successive limbs, and seen in the plane of the rows of interlocking members they lie like scales one over the next, and no large U-shaped gaps are left between neighbors.

Consequently, the wrapping threads do not pass through the attachment sections in the middle of the interlocking members, but rather around the rear of the far side from the interlocking heads. The binding chain threads lie away from the interlocking heads, in front of the rearward connecting sections.

This arrangement is not without disadvantages. Where the wrapping threads pass around the connecting sections, they come into contact with the flanks of the operating slider when the sliding clasp fastener is stretched transversely. Thus when the slider is moved the wrapping threads are abraded and undergo premature wear which damages the binding.

Transverse stresses can also displace the array of binding chain threads and wrapping threads which binds the interlocking members, which further aggravates the wear effects on the wrapping threads, caused as described by the slider.

In a different sliding clasp fastener having woven-in prefabricated rows of interlocking members and a core (German Patent document—Open Application No. DE-OS 25 19 829), but having no binding chain threads, wrapping threads encircle the core and the attachment sections, which similarly form parts of the rearward connecting sections.

The same disadvantages arise in this case, even though an additional inlay thread is provided, which lies beneath the row of interlocking members, is laid in grooves in the limbs of the interlocking members, and is bound in together with the interlocking members for the purpose of preventing displacements under transverse stretching.

Finally, the same disadvantages arise in another construction, see German Patent document—Open Application No. DE-OS 28 55 370, in which the rows of interlocking members are not attached to the top of the supporting tapes, but are bound in concentrically and provided with a core. Transverse stretching once again displaces the interlocking members in their binding, with the result that the wrapping threads come into contact with the slider flanks in spite of the inlaid core.

OBJECT OF THE INVENTION

The object of the invention is to modify and improve a sliding clasp fastener of aforedescribed type so that damaging contact can no longer occur between the wrapping threads and the flanks of the operating slider, even under substantial transverse stresses.

SUMMARY OF THE INVENTION

This object and others which will become apparent hereinafter are attained, in accordance with the invention, in a slide-fastener stringer, comprising:

- a woven support tape;
- a synthetic-resin monofilament generally helical continuous coupling element disposed along an edge of the support tape, the coupling element comprising:
- a row of interlocking members forming coupling heads projecting beyond the edge of the tape,
- a pair of limbs connected to each head and, in projection upon a plane of the slide-fastener stringer, having portions superposed at least adjacent the respective head, the limbs having attachment sections spaced from the head and located generally in a middle region of the coupling element, and respective bights forming return loops connecting a limb of one head to a limb of a successive head, thereby chaining the heads together along the coupling element, the bights being spaced from the attachment sections;

a core extending through the coupling element in the middle region so that the portions and the bights lie to opposite sides of the core; and threads attaching the coupling element and the core to a upper side of the tape, the threads including:

binding chain threads engaging the limbs on a side of the core located proximal to the interlocking members, being crossed over between successive interlocking members, and disposed in the tape beneath the middle region, whereby the coupling element is woven-in into the tape, and at least one wrapping thread engaging the attachment sections and the core and attaching the coupling element and the core to the support tape, the wrapping threads passing around the binding chain threads and having loops which pass partly around the attachment sections and draw the binding chain threads onto the attachment sections.

Thus, the invention provides that the attachment sections, seen in a projection on the plane of the sliding clasp fastener, are disposed in the middle of the interlocking members, some distance from the interlocking heads but also some distance from the rearward return loops, while the binding chain threads are disposed in the supporting tapes beneath the middle of the interlocking members and drawn on to the attachment sections by the loops of the wrapping threads which pass partly around the attachment sections.

According to the invention, moreover, the wrapping threads are countersunk between the limbs of adjacent interlocking members. This excludes damaging contact with the flanks of the sliding clasp fastener slider.

Furthermore, since the binding chain threads in the supporting tapes lie under the middle of the interlocking members and are drawn by the wrapping threads on to the attachment sections disposed in this middle area, the interlocking members and hence the rows thereof are laid so tightly on the supporting tapes that no damaging displacements can occur, even under transverse stretching, whereby the wrapping threads could be brought into contact with the flanks of the operating slider.

The effects are further enhanced by the cores, which are also preferably disposed in the middle of the interlocking members. Thus, simple means are used to prevent the aforementioned abrasive wearing action on the wrapping threads when the slider is operated, which causes the binding to fail prematurely.

The invention can be embodied in a variety of forms. Thus, in one embodiment the rearward return loops form connecting sections to unite individual interlocking members into continuous rows thereof, while the attachment sections are formed as a splayed U-shape between successive connecting sections.

In another embodiment the attachment sections also act as connecting sections between the interlocking members in the rows thereof, and are encircled by the wrapping threads.

It is within the scope of the invention to dispose an additional chain thread under the middle areas of the rows of interlocking members and to bind it into the supporting tape between the rows of interlocking members.

It is within the scope of the invention to work with a single wrapping thread for each row of interlocking members. Depending on the size of the sliding clasp fastener, the thickness of the textile threads used for the supporting tapes and the diameter of the plastics monofilament from which the rows of interlocking members are formed, it can be advantageous to provide the wrapping threads for each row of interlocking member binding together the binding chain threads, the attachment sections and the core, and to weave the wrapping threads singly and alternately in successive lines of the supporting tape structure. The effect of this is to weave each supporting tape with a pair of wrapping threads and bind both wrapping threads around the attachment sections, the core and the binding chain threads. Furthermore, the textile structure of the supporting tapes is kept in register with the structure of the rows of interlocking members.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

The sliding clasp fasteners shown in the Figures consist basically of woven supporting tapes 1 and woven-in prefabricated rows 2 of interlocking members each formed helically from a plastics monofilament.

Figure 1:
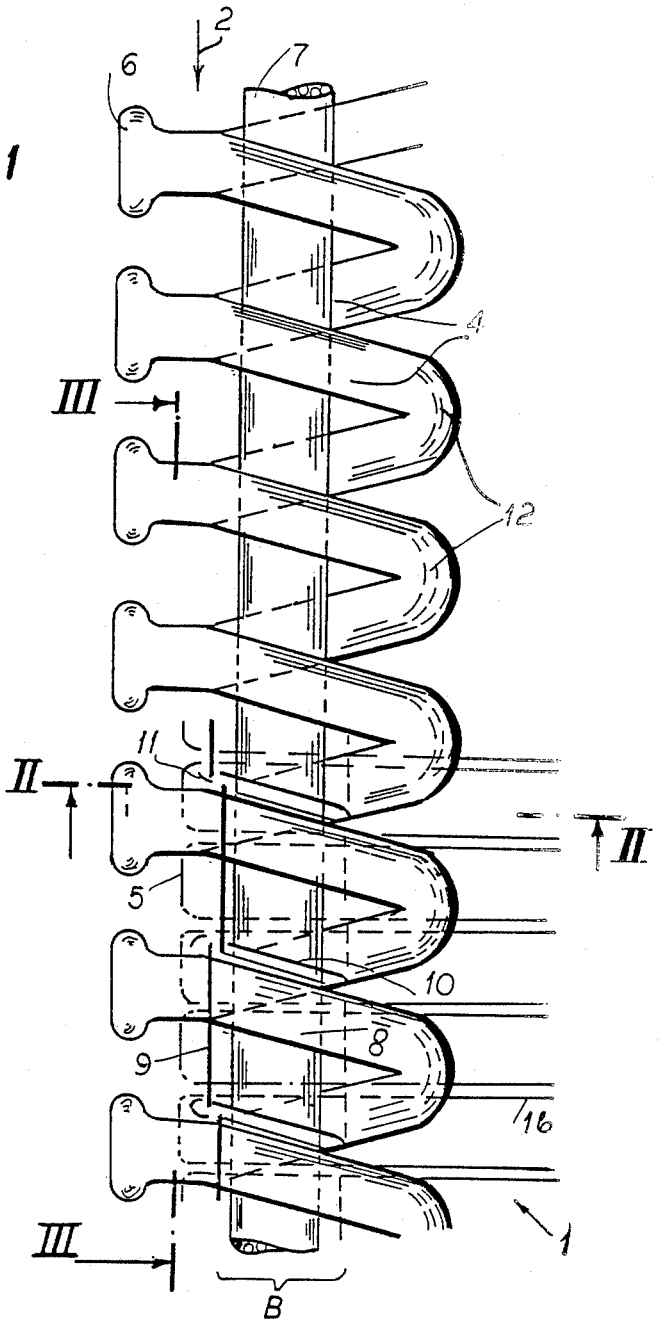
FIG. 1 is a greatly enlarged schematic plan view of part of one half of a sliding clasp fastener of the invention, the binding chain threads and wrapping threads having been removed from the upper half.
Figure 5:
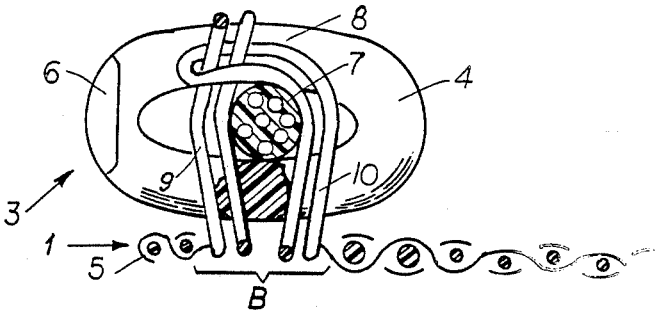
FIG. 5 is a section taken along the line V—V of FIG. 4.

It will be seen from FIGS. 1 and 5 that the interlocking members 3, seen in a projection on the plane of the sliding clasp fastener, have limbs 4 superimposed on at least the interlock side, interlocking heads 6 protruding beyond the edges 5 of the supporting tapes 1, an inserted core 7 and attachment sections 8.

Figure 2:
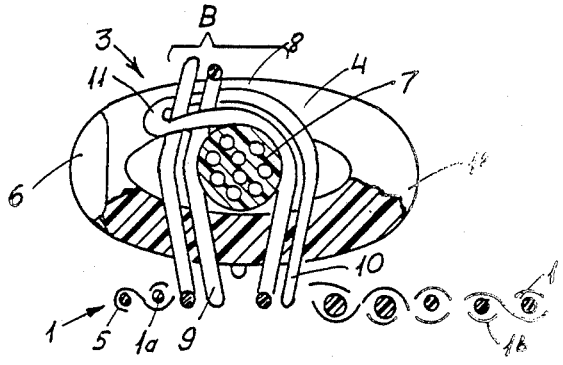
FIG. 2 is a section taken along the line II—II of FIG. 1.
Figure 3:
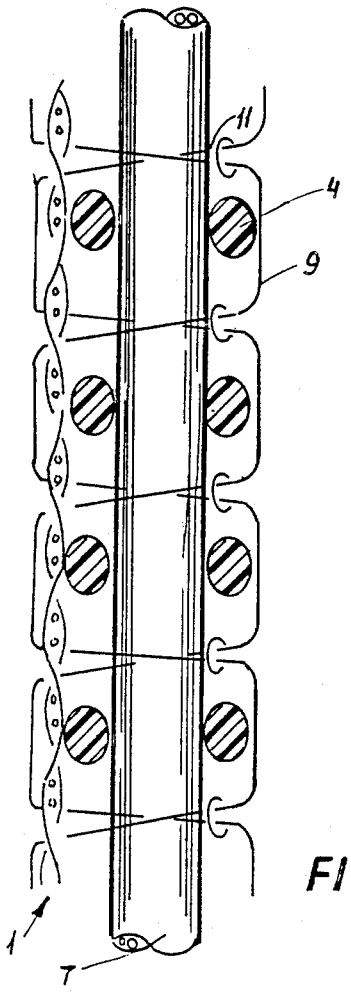
FIG. 3 is a section taken along the line IV—III of FIG. 1.
Figure 4:
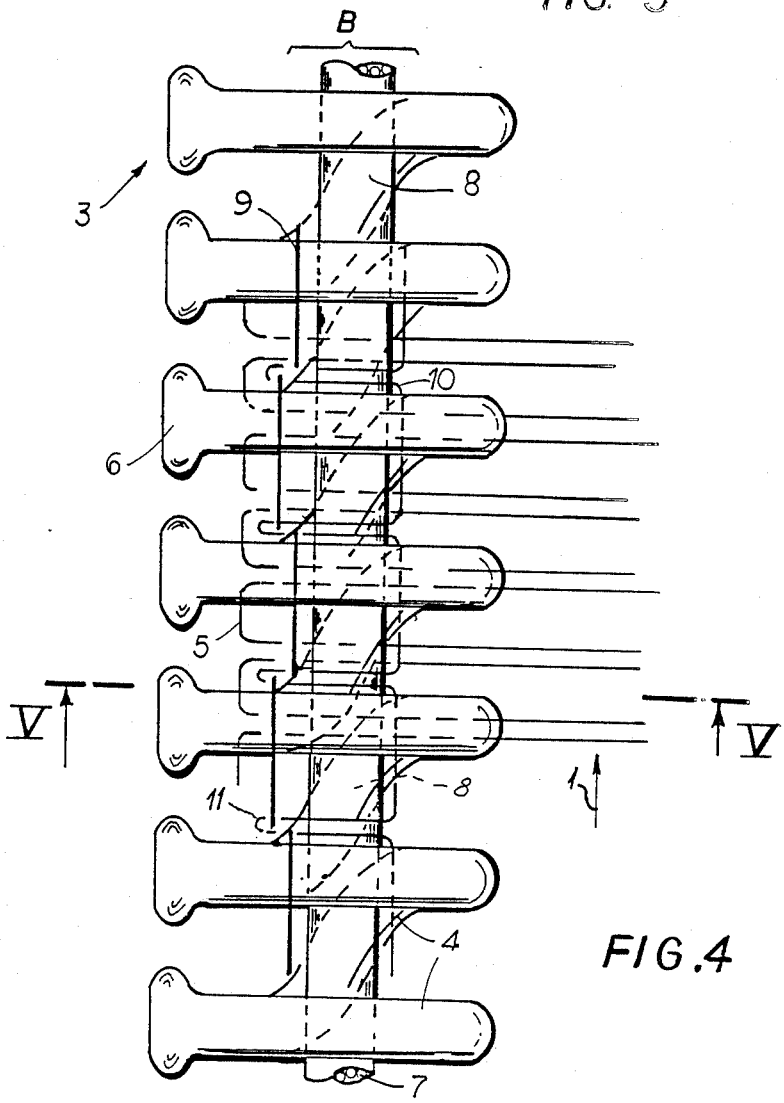
FIG. 4 view corresponding to FIG. 1 of another embodiment of a sliding clasp fastener of the invention.

It will also be seen, more particularly by comparing FIGS. 1 and 2 and/or FIGS. 4 and 5, that each row 2 of interlocking members 3 is attached to the top face of its supporting tape 1 by binding chain threads 9 engaging the interlock side of each interlocking member 3 and at least one wrapping thread 10 engaging the attachment sections 8 and the core 7 and attaching them to the supporting tape 1. The binding chain threads 9 are crossed over between successive interlocking members 3. The wrapping threads 10 pass around the binding chain threads 9 in a loop 11 between successive interlocking members 3.

The arrangement is such that the attachment sections 8, seen in a projection on the plane of the sliding clasp fastener, are disposed in the middle B of the interlocking members 3, some distance from the interlocking heads 6 but also some distance from the rearward return loops 12, while the binding chain threads 9 are disposed in the supporting tapes 1 beneath the middle B of the interlocking members 3 and drawn onto the attachment sections 8 by the loops 11 of the wrapping threads 10 which pass partly around the attachment sections 8.

In the embodiment shown in FIGS. 1 and 2, the rearward return loops 12 are adapted as connecting sections, while the attachment sections 8 are formed as a splayed U-shape between successive connecting sections.

In the embodiment shown in FIGS. 4 and 5, the attachment sections 8 also act as connecting sections between the inter locking members 3 in the rows 2 thereof, and are encircled by the wrapping threads 10.

FIG. 2 shows that an additional chain thread 13 is disposed under the middle area B and bound into the associated supporting tape 1 between the interlocking members 3.

Moreover, the cross 7 in the preferred embodiments shown are disposed in the middle areas B of the interlocking members 3. Though it is not shown, two wrapping threads 10 can be provided for each row 2 of interlocking members, binding together the binding chain threads 9, the attachment sections 8 and the core 7, while the wrapping threads 10 are woven singly and alternately in succecssive lines of the structure of the supporting tape 1.

Thus it can be seen that the slide-fastener stringer of the invention, comprises:

a woven support tape 1 formed from warp and weft threads 1*a* and 1*b*, respectively;

a synthetic-resin monofilament generally helical continuous coupling element 2 disposed along an edge 5 of the support tape 1, the coupling element 2 comprising:

a row of interlocking members forming coupling heads 6 projecting beyond the edge of the tape 1, a pair of limbs 4 connected to each head 6 and, in projection upon a plane of the slide-fastener stringer, having portions superposed at least adjacent the respective heads 6, the limbs 4 having attachment sections spaced from the heads 6 and located generally in a middle region B of the coupling element 2, and respective bights 12 forming return loops connecting a limb 4 of one head 6 to a limb 4 of a successive head 6, thereby chaining the heads 6 together along the coupling element 2, the bights 12 being spaced from the attachment sections;

a core 7 extending through the coupling element 2 in the middle region B so that the portions and the bights 12 lie to opposite sides of the core; and threads attaching the coupling element 2 and the core 7 to an upper side of the tape 1, the threads including:

binding chain threads 9 engaging the limbs 4 on a side of the core 7 located proximal to the interlocking members, being crossed over between successive interlocking members, and disposed in the tape 1 beneath the middle region B, whereby the coupling element 2 is woven-in into the tape 1, and at least one wrapping thread 10 engaging the attachment sections and the core 7 and attaching the coupling element 2 and the core 7 to the support tape 1, the wrapping thread 10 passing around the binding chain threads 9 and having loops which pass partly around the attachment sections and draw the binding chain threads 9 onto the attachment sections.

We claim:

1. A slide-fastener stringer, comprising:

a woven support tape;

a synthetic-resin monofilament generally helical continuous coupling element disposed along an edge of said support tape, said coupling element comprising:

a row of interlocking members forming coupling heads projecting beyond said edge of said tape, a pair of limbs connected to each head and, in projection upon a plane of the slide-fastener stringer, having portions superposed at least adjacent the respective head, said limbs having attachment sections spaced from said head and located generally in a middle region of the coupling element, and respective bights forming return loops connecting a limb of one head to a limb of a successive head, thereby chaining said heads together along said coupling element, said bights being spaced from said attachment sections;

a core extending through said coupling element in said middle region so that said portions and said bights lie to opposite sides of said core; and threads attaching said coupling element and said core to an upper side of said tape, said threads including:

binding chain threads engaging said limbs on a side of said core located proximal to said interlocking members, being crossed over between successive interlocking members, and disposed in said tape beneath said middle region, whereby said coupling element is woven-in into said tape, and at least one wrapping thread engaging said attachment sections and said core and attaching said coupling element and said core to said support tape, said wrapping threads passing around said binding chain threads and having loops which pass partly around said attachment sections and draw said binding chain threads onto said attachment sections.

2. The slide-fastener stringer defined in claim 1 wherein the return loops form connecting sections to unite the individual interlocking members into a continuous row thereof, while the attachment sections are formed as a splayed shanks of a U-shape between successive return loops.

3. The slide-fastener stringer defined in claim 1 wherein the attachment sections also act as connecting sections between the interlocking members in the row thereof, and are encircled by the wrapping threads.

4. The slide-fastener stringer defined in claim 1 wherein an additional chain thread is disposed under the middle region of the coupling element and bound into the supporting tape betwee successive interlocking members.

5. The slide-fastener stringer defined in claim 1 wherein two wrapping threads are provided for the row of interlocking members, binding together the binding chain threads, the attachment sections and the core, and the wrapping threads are woven singly and alternately in successive lines of the structure of the supporting tape.

* * * * *